US007147472B1

(12) United States Patent
Habersat et al.

(10) Patent No.: US 7,147,472 B1
(45) Date of Patent: Dec. 12, 2006

(54) LASER AIM SCORING SYSTEM

(75) Inventors: James D. Habersat, Woodbridge, VA (US); Brian C. Redman, Silver Springs, MD (US); Jonathan S. Lei, Springfield, VA (US); John E. Nettleton, Fairfax Station, VA (US); Michael M. Quarles, Stafford, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 671 days.

(21) Appl. No.: 10/691,455

(22) Filed: Oct. 23, 2003

(51) Int. Cl.
*F41A 33/00* (2006.01)
*F41G 3/26* (2006.01)
*G09B 19/00* (2006.01)

(52) U.S. Cl. ..... 434/16; 434/17; 434/19; 434/21; 434/23; 434/27

(58) Field of Classification Search ..... 434/11, 434/14, 16, 17, 19–26, 27, 365; 356/141.1; 244/3.11; 702/158
See application file for complete search history.

(56) References Cited

U.S. PATENT DOCUMENTS 3,889,396 A * 6/1975 Aronson ..... 434/20
3,953,132 A * 4/1976 Michelsen ..... 356/141.1
3,955,292 A * 5/1976 Robertsson ..... 434/22
4,218,834 A * 8/1980 Robertsson ..... 434/21
4,538,991 A * 9/1985 Simpson et al. ..... 434/12
4,793,811 A * 12/1988 Eichweber ..... 434/22
5,332,176 A * 7/1994 Wootton et al. ..... 244/3.11
6,549,872 B1 * 4/2003 Bollweg et al. ..... 702/158
6,669,477 B1 * 12/2003 Hulet ..... 434/14
2002/0012898 A1 * 1/2002 Shechter et al. ..... 434/21
2004/0033472 A1 * 2/2004 Varshneya ..... 434/23

OTHER PUBLICATIONS

Cartwright Electronics, Laser Aim Scoring System (LASS), www.meggitt-ce.com, Feb. 24, 1998, 3pgs, Fullerton, CA.

* cited by examiner

*Primary Examiner*—Joe H. Cheng
(74) *Attorney, Agent, or Firm*—Andrew Romero

(57) ABSTRACT

A system, called the Laser Aim Scoring System, and method for automatically scoring gunner training sessions for simulated laser-guided missile, target engagements using the laser designator without the need for training or tactical rounds are disclosed. In the disclosed invention, a pop-up target and its surrounds are separately monitored for radiations at the laser designator frequency. "Hit" or "Miss" scoring is based on detection of the laser radiation at the laser designator frequency illuminating the appropriate region around or on the target at the appropriate time with respect to a simulated missile launch signal at the start of the training engagement, in accordance with the engagement profile programmed into the scoring computer prior to the start of training. The laser aim scoring system send a signal to lower the pop-up target in response to a "Hit" score, and if desired by the user, also sends a signal to initiate smoke and flash signals from a Hoffman Kill Simulator interfaced with the system. The disclosed invention also sends the appropriate signals at the end of the engagement to reset the target in the upright position so that it is ready for the next engagement. The disclosed invention includes subsystems for transmitting data, video imagery, and control signals between the portion of the system at the target location and the portion of the system at the control tower.

6 Claims, 2 Drawing Sheets

LASER AIM SCORING SYSTEM

BACKGROUND OF THE INVENTION

1. Field of the Invention

The invention relates to training equipment for use with laser-guided weapons including bombs, rockets and artillery shells.

2. Description of Prior Art

There is a large stockpile in the military inventory of laser-guided munitions. To insure that the services achieve maximum effect from such weapons requires a sophisticated training program. Available training facilities include ground based electronic training stations, field training using Multiple Integrated Laser Engagement System (MILES) type system, which employs a laser version of the old game called "Tag", and field training using "live" training rounds. The use of ground based electronic stations, while useful for introductory training, is not the preferred method. Field training is a far more effective method. For MILES training systems, however, target ranges are limited to 3 kilometers or less because of output power limitations with state-of-the-art laser diodes. There are also problems with bore sighting of the existing MILES training systems. Field training using live training rounds, while the preferred method, is extremely limited, due to the expense and availability of the training rounds.

There is a need for an improved system of training designator operators under more realistic field conditions. As an example, for the Army Apache aircraft platform, gunners are tasked to designate targets for the laser guided Hellfire missile system. Because retrofit of the aircraft with MILES equipment is time consuming, and has performance characteristics not matching the tactical laser, it is not frequently used. Currently, training and scoring of Apache gunners is done after the training exercise using videotape from the weapons system. This delayed feedback to the gunner degrades training effectiveness.

SUMMARY OF THE INVENTION

This invention enables real time simulation and feedback to the gunner by adding a "smart" hardware interface to the pop-up targets as found on military firing ranges. The target, typically a silhouette painted on plywood, is attached to a target pop-up device. A downrange programmable microprocessor with laser sensors and video camera is located near, and interfaced to the pop-up device. The sensors include both on-target and off-target detectors that sense laser radiation at the designator frequency. If mission requirements are met (i.e. proper designator code, laser time off-target, laser time on-target), the target pop-up device is commanded to drop the target, signifying a "hit". The gunner, following proper engagement procedures, would instantly see the target drop at the proper round impact time. For added realism, the system can also command the Hoffman Target Kill Simulator to fire, adding the effects of fire and smoke to the training engagement. This fire and smoke can be seen by both the optical day sight and the thermal night sight.

A radio modem links the downrange microprocessor, laser sensors, and video camera to a personal computer (PC) located in the range control tower. The video camera is near infrared enhanced, enabling the control tower operator to view, on a video monitor, both the target and the moving laser spot on the target. The tower operator remotely operates and programs the downrange target equipment set via a menu driven software interface. Prior to a training engagement, the tower operator can verify operation of the downrange equipment set by raising and lowering the target, and test firing the Hoffman device. During a training engagement, the tower operator monitors the event, and programs the downrange microprocessor with the proper training scenario.

BRIEF DESCRIPTION OF THE DRAWINGS

The foregoing and other objects, aspects and advantages will be better understood from the following detailed description of a preferred embodiment of the invention with reference to the drawings, in which similar characters refer to similar parts, and in which.

WRITTEN DESCRIPTION OF THE PREFERRED EMBODIMENT

Figure 1:
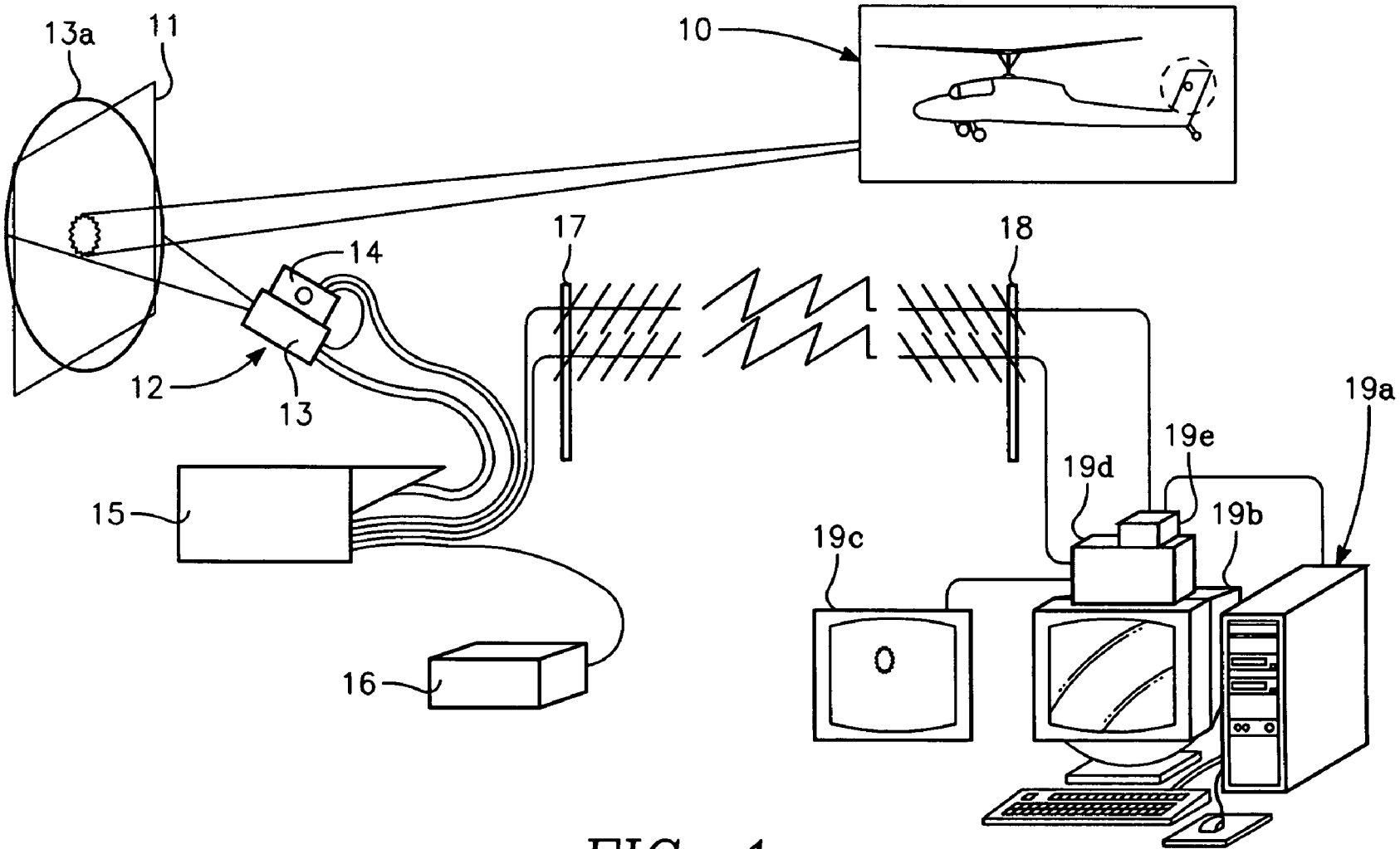
FIG. 1 is a pictorial view of a complete Laser Aim Scoring System (LASS) including a pop-up target with an electronic target monitor linked to a remote video monitor in a control tower.

Referring to FIG. 1, there is shown a complete layout of the operating system of the present invention. The system operates on the principle that the success of the target engagement is directly related to the ability of the laser designator operator (the gunner) to properly aim the laser, near or on the target, at appropriate times during the flight of the missile. The drawing portrays a helicopter 10 or flying platform, which usually involves autonomous designations, i.e. the same platform both designates the target and launches the laser-guided munitions. The same concept can involve ground-based designators and ground based munitions. The system also supports buddy lasing, where either a ground gunner or air platform designates the target, or another platform launches the weapon. The target 11 is a flat pop-up board painted to provide the same contrast with the background, as would a real target. An active test monitor 12 is placed in front of the target far enough away and low enough to not intercept the laser beam that a gunner uses to project a signature on the target. This test monitor has a lower on target section 13 that detects laser reflections from the target within the circular area 13*a*. There is also a separate upper off-target section 14 that detects weaker laser reflections above below or to either side of the target. For convenience in disassembly, fastening strips such as those that incorporate a Velcro® material join the two sections.

Figure 2:
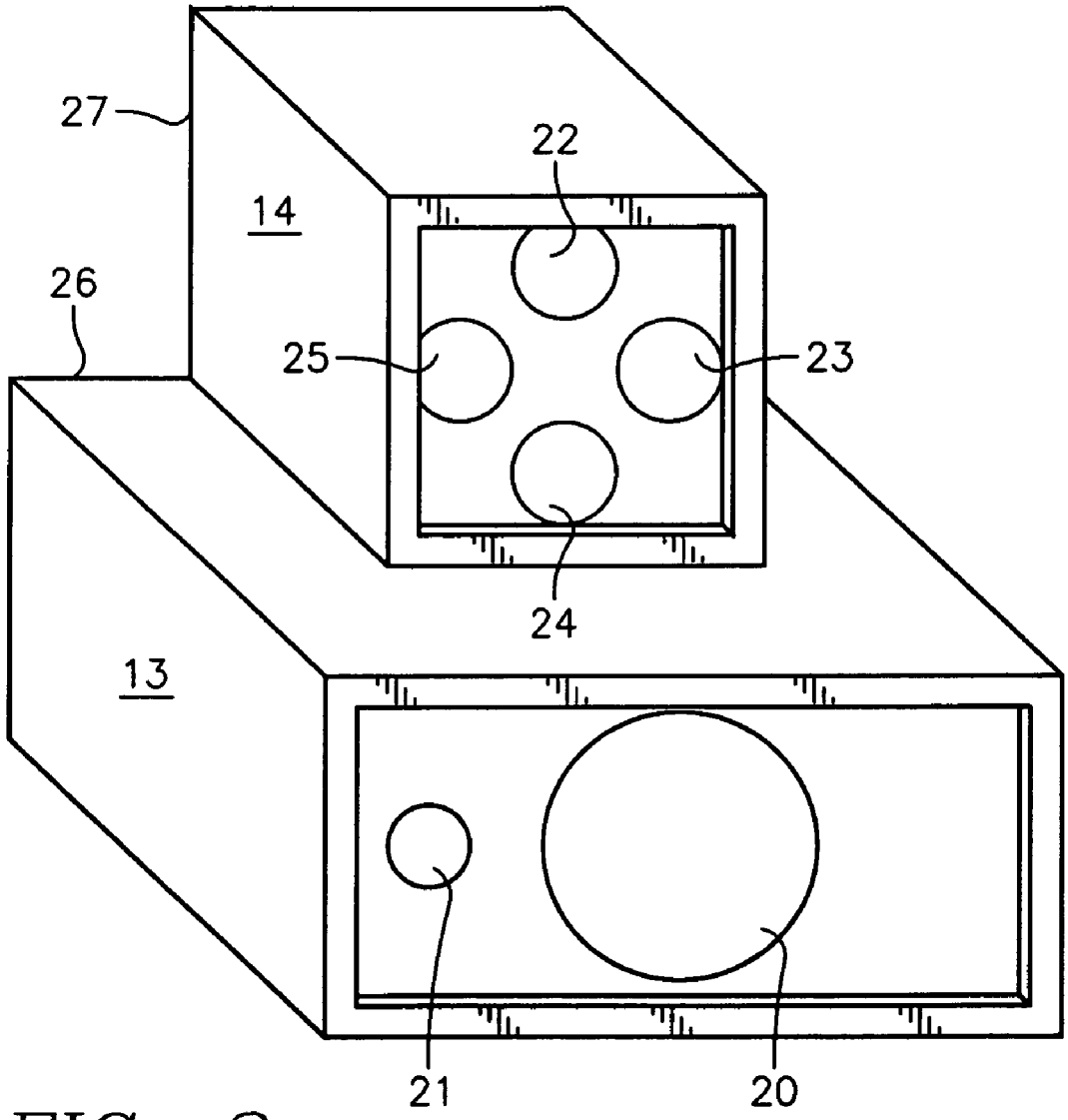
FIG. 2 is an isometric view of the target monitor.

Referring briefly to FIG. 2, the lower section 13 contains an on-target detector behind lens 20 and a video camera behind lens 21, both of which image the whole target on their focal planes. The upper section 14 contains an array of four very sensitive offset detectors behind lenses 22–25. These offset detectors cover a field of view within approximately two steradians adjacent to the target for offset laser energy. Lens 22 gathers light above the target, lens 24 gathers light in front of the target and lenses 23 and 25 gather light on either side of the target. Each detector, in either opaque housing 26 or 27, may comprise at least one photodiode or a photo-cathode with an electron multiplier in the focal plane of its lens. The lenses and housings may be specific to the detectors as shown or shared with other detectors. Threshold sensitivity for the offset detectors is set very low, so that they respond to laser designator ground scatter of a beam hitting the ground anywhere within approximately 100–200 meters of the target. The on-target detector covers only the field of view of the target for on-target laser energy. The threshold sensitivity for this detector is set much higher, so that it will respond only to lambertian scatter directly off the target. The detectors are preferably narrow-band diodes designed for predetermined infrared wavelengths.

Returning to FIG. 1, the above test monitor is shown connected to a LASS microprocessor 15, preferably by direct wiring, so that it supplies a time base for each test and computes the relative outputs of the detectors with time. It also computes a dwell time for the detectors that is weighted on their distance from the center of the target at any given time. When the computer detects a successful designation it sends a firing signal to a squib in a Hoffman Kill Simulator 16, which is an off-the-shelf pyrotechnic device that creates smoke, elevated light flashes and a loud noise for the gunner's benefit.

The system further includes a tower computer 19*a* with a normal monitor 19*b* and a passive video monitor 19*c*, which is usually located in a control tower overlooking the target range at a safe distance, so as to permit live munitions tests when needed. This computer and passive video monitor may be hard wired, but preferably receives data from the LASS microprocessor 15 by means of a modulated RF transmitter antenna 17 near the central processor and an RF detector antenna 18 in the tower. The LASS central processor is hard wired to the popup target controller. The antennas provide a video link and a separate data link on different carrier frequencies. The video link is demodulated by an RF Video Receiver and wired to the passive video monitor to show the picture from the video camera behind lens 21. The data link is demodulated by an RF data modem 19*e* that is hard wired to the remote computer 19*a*. The remote computer records the test data for comparison studies and individual gunner ratings.

The current version of LASS sends a signal to the target lifter and to the Hoffman Kill Simulator 16 in place of the signal that would be sent in live fire training in response to a hit detection by an existing target piezoelectric hit sensor on the target. Until now, when a ballistic round hits the target board, e.g. a bullet, the impact causes the piezoelectric hit sensor mounted on the target board to "ring" voltaically. This ringing effect is detected by the target lifter device and is interpreted by the range control instrumentation as a hit, and the target board dropped. Since most Hellfire training is done without actual Hellfire training rounds, these simulated engagements cannot result in piezoelectric hit detection. Instead, the LASS target suite scores the proper employment of the laser designator for offset and on-target lasing. If LASS determines a hit, it mimics the operation of a piezoelectric hit sensor, and forces the target to drop. The dropping of the target provides a visual, real time feedback to the gunner that the engagement was scored as a hit.

The training method for testing a gunner's ability to designate a target, near a control tower, with a given laser, at an impact point for a projectile seeking said designated target with a sensor for only the narrow band radiation from said given laser, includes the following steps:

[A] placing a substantially two dimensional representation of the target on a mechanism that pops the target upward to a nearly vertical (with respect to the ground plane) position or downward to a nearly horizontal position in response to an electric signal from the tower;

[B] directing a first array of high sensitivity offset sensors for the narrow band radiation toward the target and an area of ground within at least 100 meters therefrom in response to a gunner's cue signal;

[C] directing a video camera and a second array of low sensitivity sensors for the narrow band radiation only toward the space occupied by the target, when in the nearly vertical position, in response to the same cue signal;

[D] loading software into the microprocessor that defines the training scenario and proper timing for off-target and on-target lasing, and correct designator coding for a successful laser designator engagement (illumination of the area around the target and finally the target itself);

[E] transporting the gunner and given laser toward and within missile range of the target;

[F] generating the cue signal from the gunner to the tower to indicate a launch time for the missile;

[G] generating the signal from the tower to the target in response to the cue signal;

[H] feeding the actual sensor outputs to microprocessor;

[I] generating a score, in the microprocessor, based on the actual sensor outputs as a function of time as compared to the required sensor outputs;

[J] computing the time of expected missile impact at the target from the launch time in the microprocessor;

[K] generating the electric signal in the control tower, if the score exceeds a preselected hit threshold;

[L] generating an electric hit signal in the microprocessor if the electric signal of step [K] has been generated at the time of impact;

[M] transmitting the hit signal, if present, to the target raising/lowering mechanism to lower the target in the event that a hit is scored;

[N] transmitting the hit signal, if present, to a hit simulator in the form of an electrical squib, whereby the hit signal fires the squib to generate smoke and light signals visible for the subject and anyone in the control tower;

[O] storing the output signal from the video camera, as well as the computed and actual sensor output values in the computer in the control tower;

[P] clearing the microprocessor for a new test; and

[Q] generating an electric signal to raise the target board if hit signals were generated in steps [K] and [L] resulting in lowering the target board in step [M].

The gunner initially aims the laser at a point far enough from the target to avoid enemy detection but close enough to keep the missile on its path. Finally the target itself is illuminated long enough to let the missile make last minute corrections for a direct hit. The control tower equipment permanently stores the transmitted data. The scoring information can be saved on computer disk for later after action briefings, or noted in a logbook. The target video, showing size and location of the laser spot on the target, can be displayed on a passive monitor in the control tower during the test and also recorded for after action briefings.

While this invention has been described in terms of a preferred embodiment consisting of a particular test system and method of using same, is fully capable of obtaining the objects and providing the advantages above stated, it is to be understood that the presently preferred embodiments are merely illustrative of the invention. As such, no limitations are intended other than as defined in the appended claims.

What is claimed is:

1. An active aim scoring system for testing a gunner's ability to designate a pop-up target, near a control tower, with a given laser, at an impact point for a projectile seeking said designated target with a sensor for only the narrow band near infrared radiation from said given laser, comprising:

an upper section containing an array of four very sensitive offset detectors focused on the areas in front of, above, to the right of and to the left of said target within 100 meters of the target;

a lower section electronically coupled to said upper section containing an on-target detector for said near infrared radiation, and a video camera for detecting visible radiation as well as said near infrared radiation reflected by said target;

a computer to record and evaluate output data from all of said detectors; and a modulated transceiver with an antenna to receive test initiation pulses from said tower and transmit test data with evaluation to said tower.

2. An active aim scoring system according to claim 1, further comprising:

an electrically fired pyrotechnic device, adjacent said target coupled to said computer, to emit light and smoke in response to a hit pulse; and said computer having a first circuit means to generate a hit pulse in response to a favorable evaluation of said data.

3. An active aim scoring system according to claim 2, wherein said computer includes a second circuit means coupled between said computer and said target to generate a lower target pulse in response to said hit pulse and a raise target pulse in response to said test initiation pulse.

4. A training method for testing a gunner's ability to designate a target, near a control tower, with a given laser, at an impact point for a projectile seeking said designated target with a sensor for only the narrow band near infrared radiation from said given laser, comprising the steps of:

placing a substantially two dimensional representation of the target on a mechanism that pops the target upward to a nearly vertical position with respect to the ground plane or downward to a nearly horizontal position in response to an electric signal from the control tower;

directing an array of four high sensitivity offset sensors on an upper section of an active aim scoring system for the narrow band radiation toward the target and an area of ground within at least 100 meters therefrom in response to a gunner's cue signal;

directing a video camera and a low sensitivity sensor on an lower section of said active aim scoring system for the narrow band radiation only toward the space occupied by the target, when the nearly vertical position, in response to the same cue signal;

loading a designation program into a first computer that defines output signal threshold levels of the sensors as a function of time for an ideal laser illumination of the area around the target and finally the target is illuminated long enough to avoid enemy detectors and to insure proper missile impact;

transporting the gunner and the given laser toward and within missile range of the target;

generating the cue signal from the gunner to the control tower to indicate a launch time for the missile;

generating the signal from the control tower to the target in response to the cue signal;

feeding the actual sensor outputs to the first computer;

generating a score, in the first computer, based on the actual sensor outputs as a function of time as compared to the required sensor outputs;

computing the time of expected missile impact at the target from the launch time in the first computer; and generating the electric signal in the control tower, if the score exceeds a preselected hit threshold.

5. A training method according to claim 4, further comprising the steps of:

generating an electric hit signal in the first computer if the electric signal generated in the control tower has been generated at the time of impact;

transmitting the hit signal, if present, to the target mechanism to lower the target in the event that a hit is scored; and transmitting the hit signal, if present, to a hit simulator in the form of an electrical squib, whereby the hit signal fires the squib to generate smoke and light signals visible for the gunner and anyone in the control tower.

6. A training method according to claim 5, further comprising the steps of:

storing the output signal from the video camera, as well as the computer and the values of the actual sensor outputs in a second computer in the control tower;

clearing the first computer for a new test; and generating an electric signal to the target mechanism to raise the target if the hit signals were generated in the control tower resulting in lowering the target.

* * * * *